United States Patent [19]

Roussel

[11] Patent Number: 4,498,705

[45] Date of Patent: Feb. 12, 1985

[54] METHOD AND APPARATUS FOR IN-SITU MINING BY LEACHING ORES CONTAINING METAL VALUES

[75] Inventor: Jacques Roussel, Hauterives, France

[73] Assignee: L'Air Liquide, Societe Anonyme Pour L'Etude et L'Exploitation des Procedes Georges Claude, Paris, France

[21] Appl. No.: 474,270

[22] Filed: Mar. 11, 1983

[30] Foreign Application Priority Data

Mar. 17, 1982 [FR] France ..... 82 04480

[51] Int. Cl.[3] ..... E21B 43/28

[52] U.S. Cl. ..... 299/4; 299/5

[58] Field of Search ..... 299/4, 5, 7

[56] References Cited

U.S. PATENT DOCUMENTS

| | | | |
|---|---|---|---|
| 4,071,278 | 1/1978 | Carpenter et al. | 299/7 |
| 4,105,253 | 8/1978 | Showalter | 299/4 |
| 4,116,488 | 9/1978 | Hsueh et al. . | |
| 4,234,232 | 11/1980 | Smith et al. | 299/7 |
| 4,351,566 | 9/1982 | Yan et al. | 299/5 |
| 4,358,158 | 11/1982 | Showalter | 299/4 |

FOREIGN PATENT DOCUMENTS

| | | | |
|---|---|---|---|
| 2204755 | 5/1974 | France . | |
| 2424407 | 11/1979 | France . | |
| 607020 | 5/1978 | U.S.S.R. | 299/4 |

OTHER PUBLICATIONS

*Perry's Chemical Engineer's Handbook*, Perry, Chilton, Kirkpatrick, 4th Ed., 1963, pp. 5–19, 5–20.

Anderson et al., Gas Phase Controlled Mass Transfer in Two Phase Annular Horizontal Flow, A.I.Ch.E. Journal, Sep. 1964, pp. 640–645.

McCabe et al., Unit Operations of Chemical Engineering (3d Ed.) 1976, pp. 84–117.

*Primary Examiner*—Stephen J. Novosad
*Assistant Examiner*—Mark J. DelSignore
*Attorney, Agent, or Firm*—Lee C. Robinson, Jr.

[57] ABSTRACT

An oxygenated lixiviant is transported down an injection pipe into the leach zone at the bottom of an injection pipe, the lixiviant leaches the ore and the pregnant lixiviant containing metal compounds is recovered through a recovery pipe. The metal compounds are separated from the lixiviant and the lixiviant is regenerated, reoxygenated and recycled. The pressure of the lixiviant at the downstream end of the injection pipe is substantially equal to the pressure of the lixiviant at the upstream end thereby permitting maximum oxygenation without any degassing.

19 Claims, 3 Drawing Figures

METHOD AND APPARATUS FOR IN-SITU MINING BY LEACHING ORES CONTAINING METAL VALUES

Figure 1:
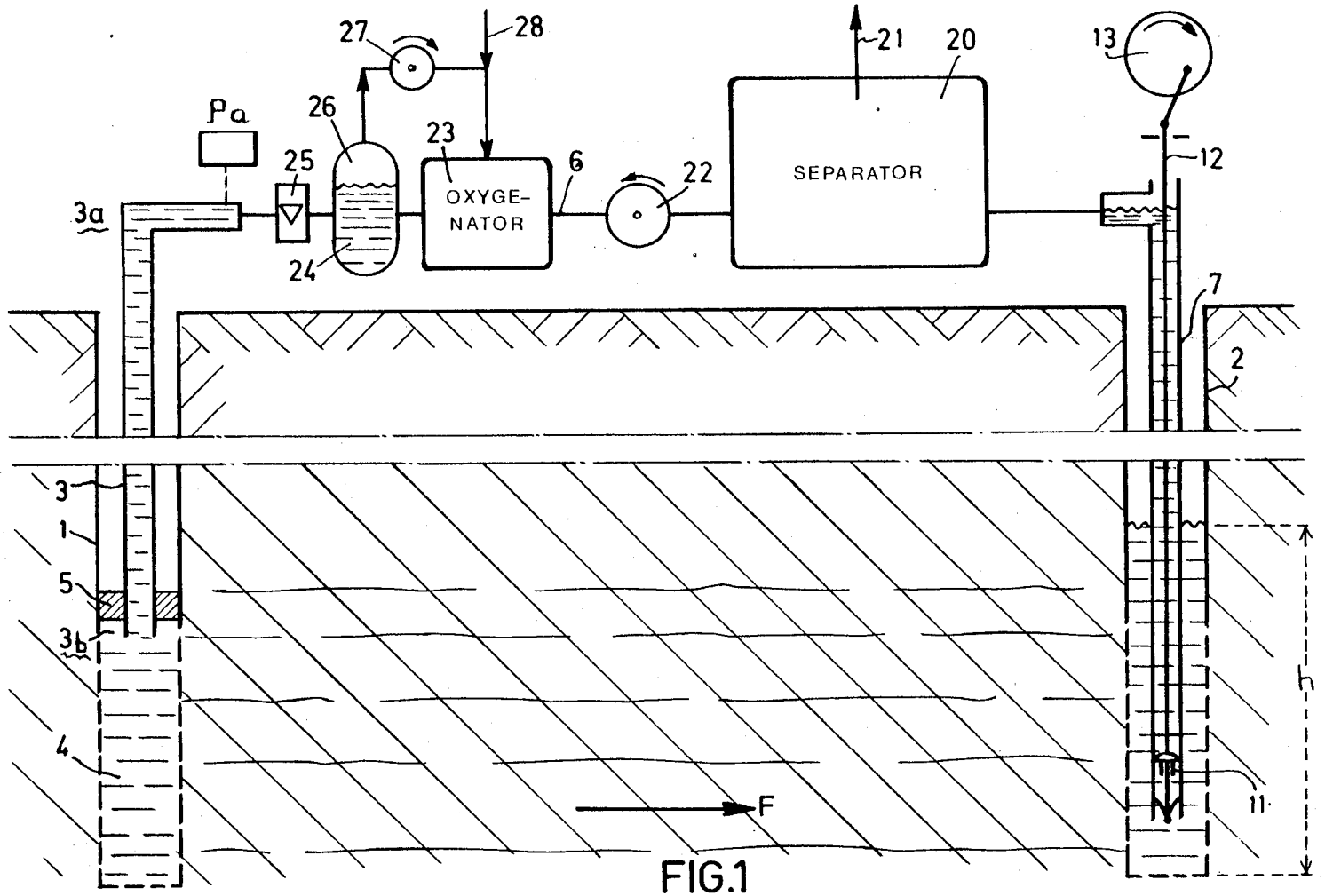

The present invention relates to a method and apparatus for in-situ mining by leaching ores containing metal values, including, inter alia, nickel, cobalt, copper and uranium.

In such a method a lixiviant is used comprising a leach solution or liquor admixed with oxygen which is circulated in a pipe positioned in an injection hole. The pipe opens at its downstream end in a leach zone at the bottom of the injection hole. The resulting pregnant lixiviant containing metal compounds of the ore is recovered from one or more production holes and is treated to separate the metal compounds. The lixiviant is regenerated, possibly adding the starting products, reoxygenated and recycled in the injection hole. In practice a network of a plurality of injection holes are distributed over the surface with a plurality of production holes spaced therefrom. Generally, as an oxidizer, oxygen dissolved in the leach solution is used since it is less expensive than oxygenated water, but its low solubility in aqueous solutions makes its use difficult.

A first drawback of the use of oxygen in a lixiviant resides in the formation of oxygen bubbles having a diameter greater than a few tens of microns when sufficient amounts of oxygen are admixed with the lixiviant, thereby forming a two-phase mixture which has difficulties to flow through the extremely small fractures in the rock. It is then necessary to fracture artificially the ore between the injection and the production holes, for example, by blasting, which enables the passage of the two-phase lixiviant, but such an operation is delicate and expensive.

This is the reason it was proposed in a recent U.S. Pat. No. 4,116,488 to prepare a lixiviant which, although in two-phase state, is in the form of a liquid with minute bubbles distributed therein, and the reason that one endeavors to avoid the coalescence of bubbles during injection. More specifically, the two-phase lixiviant injected into the leach zone is recycled by a venturi aspirator or exhauster so as to prevent the formation of a gas pocket, and to further improve the stability of the two-phase mixture by trying to prevent the coalescence of bubbles, a surfactant is added to the lixiviant.

This known proposal requires a venturi device be arranged at the bottom of the hole which is a delicate operation and moreover risks blocking the hole. In fact, it is illusory to hope to maintain, without any coalescence of the bubbles, a flow of the two-phase fluid in a vertical pipe hundreds of meters long notwithstanding the arrangements indicated above. Furthermore, in a vertical pipe of such length, the pressure is far from constant and in fact increases linearly from the surface or ground level to the top of the leach zone where it reaches a value slightly less than a limit which corresponds to the fracturing pressure of the surrounding rock. In actual fact the average pressure in the vertical injection pipe is approximately half the fracturing pressure at the top of the leach zone and therefore the concentration of dissolved oxygen is at most equal to half what might be hoped for with the operating pressure in the leach zone. For all these reasons the efficiency of oxygen utilization is low, of the order of 40%.

An object of the present invention is a method of in-situ mining by leaching ores which avoids all of the foregoing drawbacks by reliably eliminating any formation of oxygen bubbles while approaching in the entire leach zone the saturation point for a pressure slightly less than the fracturing pressure of the rock. Thanks to this measure the lixiviant is highly effective as regards the dissolving of the ore whereby an efficiency of oxygen utilization very close to 100% may be obtained.

According to the invention there is provided a method for in-situ mining by leaching ore with a two-phase lixiviant comprising a leach solution or liquor admixed with oxygen, in which the lixiviant flows down an injection pipe arranged in an injection hole and opening at its downstream end into a leach zone at the bottom of the injection hole, the lixiviant being allowed to leach the ore in the leach zone thereby producing pregnant lixiviant containing metal compounds of the ore, recovering the pregnant lixiviant from a production hole, separating the metal compounds from the pregnant lixiviant, regenerating the lixiviant, possibly adding leach solution or liquor, reoxygenating the lixiviant, and recycling the reoxygenated lixiviant down the injection pipe, the method comprising generally the following (a) The inner diameter of the injection pipe is selected taking into account the volumetric flow rate of the lixiviant, the hydrostatic increase in pressure, and the drop in pressure due to loss of head during the transportation from the upstream end to the dowmnstream end of the injection pipe so that the pressure of the lixiviant at the downstream end of the injection pipe is substantially equal to the pressure of the lixiviant at the upstream end of the injection pipe and the pressure of the lixiviant being transported down the injection pipe is never substantially less than the pressure at the upstream end of the pipe;

(b) The pressure of the lixiviant at the upstream end of the injection pipe is selected to be less than the fracturing pressure of the rock at the top of the leach zone; and (c) The concentration of the dissolved oxygen in the lixiviant oxygenated at the upstream end of the injection pipe is maintained at a value less than the saturation point for the pressure of the lixiviant at the upstream end of the injection pipe.

Studies have been undertaken by the applicant taking into account the problem posed: first, to provide a two-phase lixiviant which has the highest possible oxygen concentration (and therefore the highest possible oxygen pressure) and secondly, to eliminate the risk of degassing causing the formation of oxygen bubbles which reduce the efficiency of the method (i.e., to avoid a pressure drop) during the transportation of the two-phase lixiviant down the injection pipe.

The following observations were made in the course of these studies. (i) For large diameter injection pipes the drop in pressure due to loss of head is less than the increase in pressure due to hydrostatic effects. The pressure of the two-phase lixiviant at the downstream end of the pipe is therefore greater than the pressure at the upstream end which means that there is no risk of degassing. On the other hand, it was not possible to dissolve as much oxygen in the leach solution as desired. (ii) For small diameter injection pipes the drop in pressure due to loss of head is greater than the increase in pressure due to the hydrostatic effect. The pressure of the two-phase lixiviant at the downstream end of the pipe is therefore less than the pressure at the upstream end. This means that it was possible to dissolve as much oxygen as possible in the lixiviant but there is a risk of degassing since there is a drop in pressure along the pipe, and therefore of desaturation of the lixiviant.

In light of these observations the applicant contemplated selecting an injection pipe diameter such that, on the one hand, the values of the pressure of the lixiviant are substantially equal at the upstream and downstream ends of the pipe, and, on the other hand, the pressure of the lixiviant during its transportation down the pipe does not drop substantially below the value of the pressure at the upstream end. Thus, owing to the method according to the invention defined above, an amount of oxygen close to the saturation value could be dissolved in the lixiviant at ground level without causing subsequent untimely degassing since there is no substantial drop in pressure during the transportation of the lixiviant through the pipe.

According to a first mode of the method, the inner diameter of the injection pipe is selected so that the pressure of the lixiviant is substantially constant during its transportation down injection pipe. More specifically, the inner diameter of the pipe was calculated by conventional methods such as described by Warren L. McCabe and Julian C. Smith in the handbook "Unit Operations of Chemical Engineering." For example the diameter may be determined by the formula:

$$[32fQ^2/(\pi^2 g)]^{1/5}$$

wherein:

Q is the volumetric flow rate of the solution, in $m^3/s$ $f=0.0014+0.125\ Re^{-0.32}$ where $Re=4\rho Q/(\pi d\mu)$ $g=9.81\ m/s^2$ $\rho$ is the density of the solution, in $kg/m^3$, and $\mu$ is the dynamic viscosity of the solution, in pascal seconds.

According to a second mode of carrying out the method, the inner diameter of the injection is selected so that the pressure of the lixiviant increases, preferably slightly, during its transportation down the injection conduit. The value of the pressure of the lixiviant at the downstream end of the conduit is lowered to a value just equal to that of the pressure of the lixiviant at the downstream end of the pipe by throttling the lixiviant through constriction means arranged in the lower part of the pipe.

According to a third mode of carrying out the method the inner diameter of the injection pipe is selected so that the pressure of the lixiviant increases, preferably slightly, as it is transported down the pipe. The value of the pressure of the lixiviant at the downstream end of the pipe is reduced to a value barely greater than that of the pressure at the upstream end of the pipe by throttling the lixiviant through constriction means arranged in the lower part of the pipe. The difference between the pressure at the downstream end and the pressure at the upstream end is preferably less than or equal to 1 bar.

According to the second and third modes of the method the constriction means arranged in the lower part of the injection pipe may, for example, comprise a sharp edge orifice or a valve adjustable by suitable means provided at ground level. The diameter of the constriction orifice is calculated as a function of the sought-after result by conventional methods such as described in the above-cited handbook "Unit Operations of Chemical Engineering".

According to the second and third modes of the method, the inner diameter d of the injection pipe may, for example, be determined by the following formula:

$$[32fQ^2/(\pi^2 g)]^{1/5}$$

where:

Q is the volumetric flow rate of the lixiviant, in $m^3/s$ $f=0.0014+0.125\ Re^{-0.32}$ which $Re=4\rho Q/(\pi d\mu)$ $g=9.81\ m/s^2$ $\rho$ is the density of the solution, in $kg/m^3$, and $\mu$ is the dynamic viscosity of the solution, in pascal seconds.

According to another aspect of the invention there is provided an apparatus for carrying out the method according to the invention, in which an injection hole is equipped with an injection pipe, the injection pipe being connected at its upstream end to an oxygenator which is supplied with regenerated lixiviant by a pressure pump, said apparatus comprising a flow rate measuring means, and the inner diameter of the injection pipe being selected so that the pressure of the lixiviant at the downstream end of the injection pipe is substantially equal to the pressure of the lixiviant at the upstream end of the injection pipe.

According to a preferred feature of the apparatus, the inner diameter d of the injection pipe is determined substantially in accordance with the following formula:

$$[32fQ^2/(\pi^2 g)]^{1/5}$$

where f, Q and g have the definitions given above.

According to an alternative embodiment of the apparatus constriction means are arranged in the lower part of the injection pipe.

Figure 2:
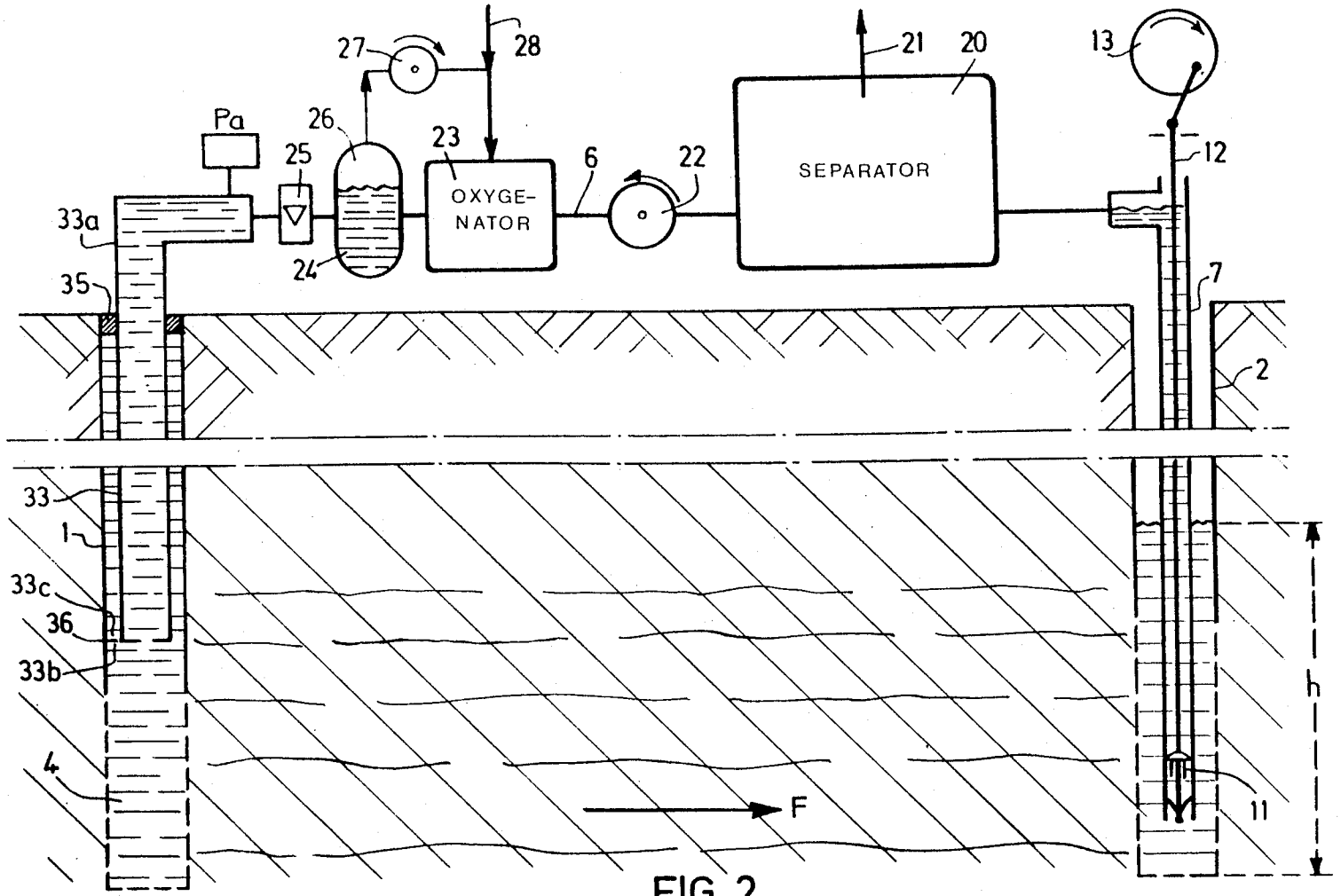
Figure 3:
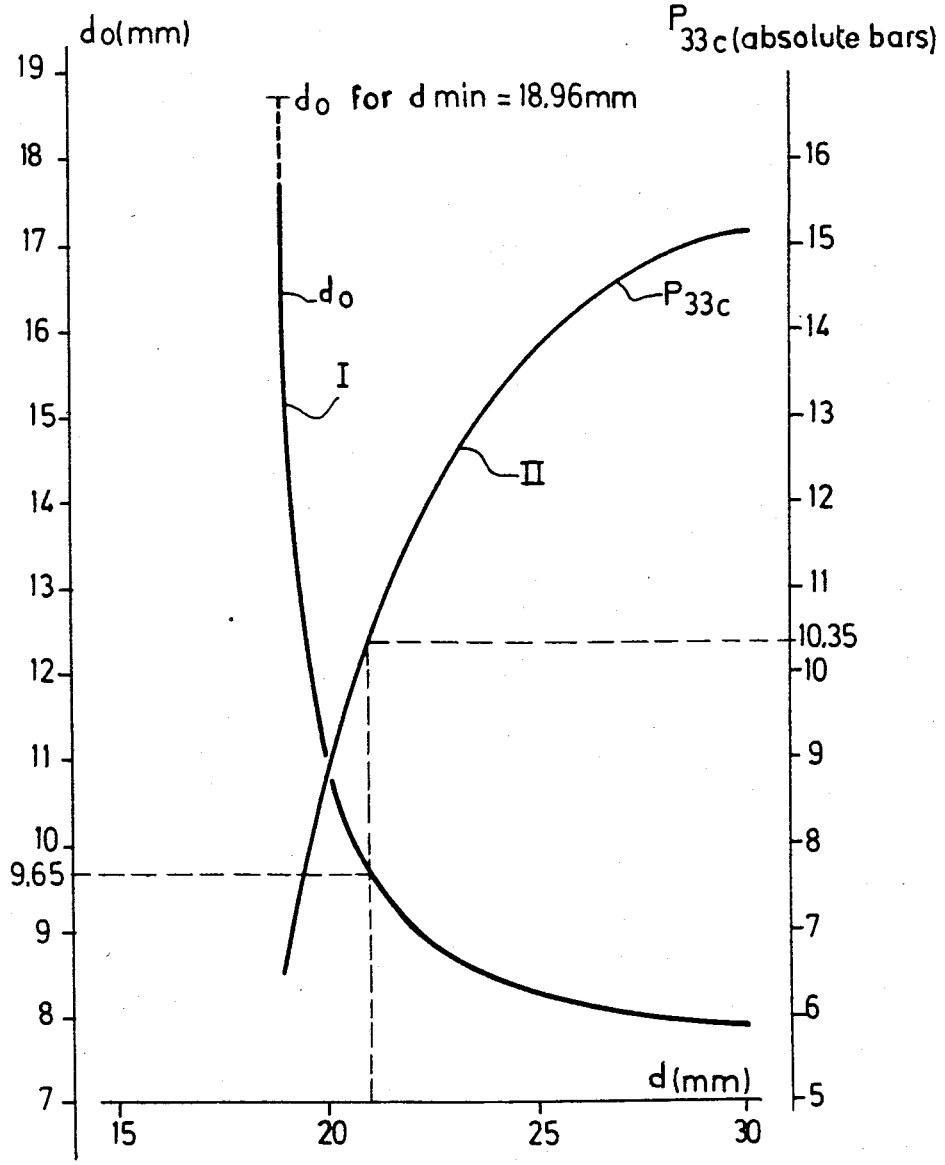

These and other features and advantages of the invention will be brought out in the description which follows, given by way of example, with reference to the accompanying drawings, in which FIG. 1 is a diagrammatic sectional view of a first embodiment of the apparatus for in-situ mining by leaching ore;

FIG. 2 is a diagrammatic view of a second embodiment of the apparatus for in-situ mining; and FIG. 3 is a graph in which the inner diameter of the injection pipe is plotted along the abscissa and the diameter of the orifice of constriction means is plotted along the ordinate.

In FIG. 1 is shown an apparatus comprising in the ground a plurality of injection holes of which only one is represented at 1. The injection holes are uniformly distributed along the surface. A plurality of production or recovery holes are also provided of which only one is shown at 2. The production holes are likewise uniformly distributed between the injection holes. Each injection hole is equipped with an injection pipe which opens at its downstream end into a leach zone. The pipe 3 traverses a sealing member 5 extending across the injection hole and is arranged slightly above the downstream end of the pipe 3.

The two-phase lixiviant consisting of a leach solution or liquor containing dispersed oxygen is supplied to each injection pipe 3 at the surface or ground level by a pipe 6 which is connected at one end to the upstream end of the pipe 3 at the surface or ground level and at the other end to the upstream end of a recovery pipe 7 at the surface or ground level. Each recovery pipe 7 is accommodated in a production hole 2 and has an lower end which is lower than the downstream end of the corresponding injection pipe 3 but nonetheless at an intermediate level in the leach zone 4. Each recovery pipe 7 comprises a volumetric pump 11 disposed proximate to its lower end which is driven by, for example, a vertical shaft 12 connected to an eccentric drive 13.

In operation the pregnant lixiviant containing dissolved metal compounds extracted from the ore flows in the direction of arrow F and is pumped up the recovery pipe 7 to the pipe 6 which recycles and returns it to the injection hole 3. The pipe 6 comprises in succession from the recovery pipe 7, a separator 20 from which is extracted at 21 metal values from the pregnant lixiviant. A pressure pump 22 pumps the lixiviant at high pressure, little less than the fracturing pressure of the rock, to a supersaturating oxygenator 23 and a phase separator 24. Only the liquid phase is directed to the injection hole 3 by flow rate measuring means 25 whereas the gas phase 26 is recycled by a supercharger 27 back to the oxygenator 23 preferably by a pipe supplying oxygen 28 to the oxygenator 23. The oxygenator 23 is preferably a tube-type reactor such as described for example by J. D. Anderson, R. E. Bollinger and D. E. Lamb in an article entitled "Gas Phase Controlled Mass Transfer in Two Phase Annular Horizontal Flow", A.I. Che. Journal, September 1964.

According to an embodiment illustrated in FIG. 1 the inner diameter d of the injection pipe 3 is selected (for example, according to the formula $$[32fQ^2/(\pi^2 g)]^{1/5}$$

so that the pressure of the two-phase lixiviant which has a value of $P_{3a}$ at the upstream end 3*a* of pipe 3 remains constant while it is transported down the injection pipe. More specifically, from the upstream end 3*a* to the downstream end 3*b*, at each unit level of the injection pipe the fall in pressure due to loss of head is just equal to the increase in pressure due to the hydrostatic effect, whereby the pressure of the two-phase lixiviant remains constant along its path down the injection pipe 3 and its value $P_{3b}$ at the downstream end 3*b* is equal to the value $P_{3a}$ at the upstream end 3*a*. Thus, a maximum value of $P_{3a}$ may be selected (which is nonetheless slightly less than the fracturing pressure of the rock) and therefore an amount of dissolved oxygen as high as possible without the risk of oxygen degassing since the pressure of the two-phase lixiviant remains constant and $P_{3b}=P_{3a}$.

The installation at the bottom of each recovery pipe 7 of a volumetric pump 11 having a flow rate which is the flow rate Q carried by the injection pipe 3 (assuming the number of recovery pipes 7 is equal to the number of injection pipes 3) permits self-regulation in case of a change in the permeability of the rock in which the mining operation is being carried out. Indeed, the corresponding change in the loss of head is then exactly compensated for by a variation in the level h of the pregnant lixiviant in the production holes. The flow rate Q measured by the flow rate measuring means 25 and the pressure at points 3*a* and 3*b* are recorded. In should be noted that no valve or similar flow control device is necessary for providing such regulation.

Moreover, if, because of any accident, the flow of the lixiviant though the ground is abruptly stopped (total clogging), such stoppage is easily detected by observing an abrupt increase in the pressure at point 3*a* and an abrupt decrease of the production flow rate. A dangerous increase of the pressure at point 3*b* can be prevented by simply stopping the pressure pump 22.

In FIG. 2 is illustrated an in-situ mining apparatus for leaching ore, a large part of which is similar to the apparatus illustrated in FIG. 1 (wherein the same reference character identifies like parts). Said apparatus comprises a plurality of injection holes 1 and of production holes 2. Each production hole 2 is similar to the production hole shown in FIG. 1. The recovery pipe 7 is connected at its upper end at the surface to a pipe 6 which is connected successively to a separator device 20, a pressure pump 22, a supersaturating oxygenator 23, a phase separator 24, and flow rate measuring means 25, and terminates at the upstream end of the injection pipe 33 for the injection hole 1.

The injection pipe 33 has a diameter greater than that of injection pipe 3 of the FIG. 1 embodiment. The pipe 33 traverses a sealing member 35 extending across the injection hole, for example, at the top of the injection hole 1. The pipe 33 comprises at its downstream end a sharp edge orifice 36 which narrows its diameter at that location.

According to the embodiment of FIG. 2, the inner diameter d of the injection pipe 33 is selected (for example, according to the formula $d>[32fQ^2/(\pi^2 g)]^{1/5}$ so that the pressure of the lixiviant which has a value of $P_{33a}$ at the upstream end 33*a* of the pipe 33 increases, preferably slightly, as it is transported down the pipe to a value of $P_{33c}$. More specifically, from the upstream end 33*a* to level 33*c* just above or upstream of the sharp edge outlet orifice 36, at each unit level of the pipe 33, the fall in pressure due to the loss of head is less than the increase in pressure due to the hydrostatic effect, whereby the pressure of the lixiviant reaches a value $P_{33c}$ at level 33*c* which is greater, and preferably just slightly greater, than the value $P_{33a}$. This increase in pressure is compensated by throttling the lixiviant through the orifice 36 and the pressure of the lixiviant is reduced at the downstream end 33*b* to a value $P_{33b}$ which, according to the selected diameter for the orifice 36, is just equal to the upstream pressure $P_{33a}$, or barely greater than $P_{33a}$ (the difference between $P_{33b}$ and $P_{33a}$ in this case preferably does not exceed 1 bar).

Preferably the difference between pressure $P_{33c}$ of the lixiviant upstream of the orifice 36 and pressure $P_{33b}$ downstream of the orifice 36 is less than 5 bars.

Three nonlimiting examples of operating modes of the method will now be given.

EXAMPLE 1

The method is carried out in the apparatus shown in FIG. 1.

The injection pipe 3 in injection hole 1 has a length of 110 m and an inner diameter of 18,58 mm.

The flow rate of the lixiviant in pipe 3 is 1.25 l/s. The lixiviant contains 0.5 g/l of $H_2SO_4$, 6.25 g/l of $CaCl_2$ and 1.75 g/l of $CaSO_4$. The concentration of dissolved oxygen is 200 ppm.

The ground temperature is 35° C. and the temperature at the bottom of the injection hole is 40° C., the average temperature in the injection pipe 3 being 37.5° C.

The pressure of the lixiviant $P_{3a}$ at the upstream end of pipe 3 is 6.5 bars. As this pressure remains constant along the flow path of the lixiviant down pipe 3, the pressure $P_{3b}$ to the downstream end of the pipe is also 6.5 bars.

In these conditions the maximum concentration of dissolved oxygen at the bottom of the injection hole is 200 ppm of oxygen. It should be noted that a little more than 200 ppm of oxygen (e.g. 210 ppm) could have been dissolved in the leach liquor. However, to avoid any risk of degassing due to the increase of temperature a little less oxygen is dissolved than the maximum possible concentration.

EXAMPLE 2

The method is carried out in the apparatus illustrated in FIG. 2.

The injection pipe 33 in injection hole 1 has a length of 110 mm and an inner diameter of 20.96 mm. The diameter of the orifice 36 is 9.23 mm.

The leach solution has the same composition as in Example 1. The oxygen concentration is 200 ppm. The lixiviant is conveyed down the injection pipe 33 at a flow rate of 1.25 l/s.

The average temperature in the injection pipe 33 is 37.5° C. (the temperature at the surface is 35° C. and the temperature at the bottom of the injection pipe is 40° C.).

The pressure of the lixiviant $P_{33a}$ at the upstream end of the injection pipe 33 is 6.3 bars. The pressure increases slightly as it is transported down the injection pipe 33 and reaches a value $P_{33c}$ of 11 bars at level 33*c*, just above or upstream of orifice 36. After the lixiviant passes through orifice 36 the pressure falls to a value $P_{33b}$ of 6.5 bars.

Under these conditions the maximum concentration of dissolved oxygen at the bottom of the injection hole is 200 ppm.

As regards the maximum possible concentration of dissolved oxygen in the lixiviant at the surface, the remark made in this respect in Example 1 applies here.

EXAMPLE 3

The method is carried out in the apparatus illustrated in FIG. 2.

The injection pipe 33 in injection hole 1 has a length of 110 m and the sealing member is disposed at 55 m from the upstream or surface end of the injection hole 1.

The leaching solution contains 0.5 g/l of $H_2SO_4$, 6.25 g/l of $CaCl_2$ and 1.75 g/l of $CaSO_4$. The concentration of dissolved oxygen in the leaching solution is 180 ppm. The oxygenated lixiviant is conveyed down the injection pipe 33 at a flow rate of 1.25 l/s.

The ground temperature at the surface is 35° C. and the temperature at the bottom of the injection hole is 40° C., for an average temperature of 37.5° C. in the injection pipe.

The desired pressure $P_{33a}$ of the lixiviant at the upstream end of the injection pipe 33 is 5.5 bars and the pressure $P_{33b}$ at the downstream end of the injection pipe is 6.5 bars.

Under these conditions the maximum concentration of dissolved oxygen at the bottom of the injection hole is 180 ppm.

The diameter of the orifice 36 is a function of the inner diameter of the conduit 33, the flow rate of the lixiviant, the selected upstream pressure $P_{33a}$ and downstream pressure $P_{33b}$, as well as the properties of the lixiviant.

In FIG. 3 are shown curves, taking into account the aboveselected parameters, of the diameter of the orifice 36 and the pressure $P_{33c}$ of the lixiviant just above or upstream from the orifice 36 plotted as a function of the inner diameter of the injection pipe 33.

Thus, for example, if the injection pipe available has an inner diameter d of 21 mm, from curve I of the graph of FIG. 3 we see that the diameter $d_0$ of the orifice 36 should be 9.65 mm. From curve II of the graph of FIG. 3, we see that the pressure $P_{33c}$ of the lixiviant just above or upstream from the orifice 36 will reach 10.35 bars.

It should be recalled that the difference between the pressure $P_{33c}$ upstream of the orifice 36 and the pressure $P_{33b}$ downstream of the orifice 36 should preferably be less than 5 bars. Therefore $P_{33c}$ should not exceed 11.5 bars.

What is claimed is:

1. In a method for in-situ mining by leaching ore with a two-phase lixiviant comprising a leach solution or liquor admixed with oxygen, circulating the lixiviant down an injection pipe arranged in an injection hole and opening at its downstream end into a leach zone at the bottom of the injection hole, allowing the lixiviant to leach the ore thereby producing pregnant lixiviant containing metal compounds of the ore, recovering the pregnant lixiviant from a production hole, separating the metal compounds from the lixiviant, regenerating and reoxygenating the lixiviant, and recycling the reoxygenated lixiviant down the injection pipe, the improvement comprising the steps of:

(a) selecting the inner diameter of the injection pipe taking into account the volumetric flow rate of the lixiviant, the hydrostatic increase in pressure and the drop in pressure due to loss of head during the transportation of the lixiviant from the upstream end to the downstream end of the injection pipe so that the pressure of the lixiviant at the downstream end of the injection pipe is substantially equal to the pressure of the lixiviant at the upstream end of the injection pipe and the pressure of the lixiviant being transported down the injection pipe is at no time substantially less than the pressure at the upstream end of the pipe;

(b) maintaining the pressure of the lixiviant at the upstream end of the injection pipe less than the fracturing pressure of the rock at the top of the leach zone; and (c) maintaining the concentration of the dissolved oxygen in the lixiviant at a value less than the saturation point for the pressure of the lixiviant at the upstream end of the injection pipe.

2. The method of claim 1, wherein the pressure of the lixiviant at the upstream end of the injection pipe is maintained at a value slightly less than the fracturing pressure of the rock at the top of the leach zone, and the concentration of dissolved oxygen in the lixiviant is maintained at a value slightly less than the saturation point for the upstream pressure of the lixiviant.

3. The method of claim 2, wherein the inner diameter of the injection pipe is selected so that the pressure of the lixiviant is substantially constant as it is transported down the injection pipe.

4. The method of claim 3, wherein the inner diameter d of the injection pipe is determined substantially in accordance with the formula:

$$[32fQ^2/(\pi^2 g)]^{1/5}$$

where

Q is the volumetric flow rate of the lixiviant, in $m^3/s$ $f=0.0014+0.125\ Re^{-0.32}$ with $Re=4\ \rho Q/(\pi d\mu)$ $g=9.81\ m/s^2$ $\rho$ is the density of the solution, in $kg/m^3$, and $\mu$ is the dynamic viscosity of the lixiviant, in pascal seconds.

5. In a method for in-situ mining by leaching ore with a two-phase lixiviant comprising a leach solution or liquor admixed with oxygen, circulating the lixiviant down an injection pipe arranged in an injection hole and opening at its downstream end into a leach zone at the bottom of the injection hole, allowing the lixiviant to leach the ore thereby producing pregnant lixiviant containing metal compounds of the ore, recovering the pregnant lixiviant from a production hole, separating the metal compounds from the lixiviant, regenerating and reoxygenating the lixiviant, and recycling the reoxygenated lixiviant down the injection pipe, the improvement comprising the steps of:

(a) selecting the inner diameter of the injection pipe taking into account the volumetric flow rate of the lixiviant, the hydrostatic increase in pressure and the drop in pressure due to loss of head during the transportation of the lixiviant from the upstream end to the downstream end of the injection pipe so that the pressure of the lixiviant slightly increases as it is transported down the injecting pipe, and reducing the pressure of the lixiviant to a pressure substantially equal to that of the pressure at the upstream end by throttling the solution through constriction means arranged at the downstream end of the injection pipe;

(b) maintaining the pressure of the lixiviant at the upstream end of the injection pipe less than the fracturing pressure of the rock at the top of the leach zone; and (c) maintaining the concentration of the dissolved oxygen in the lixiviant at a value less than the saturation point for the pressure of the lixiviant at the upstream end of the injection pipe.

6. In a method for in-situ mining by leaching ore with a two-phase lixiviant comprising a leach solution or liquor admixed with oxygen, circulating the lixiviant down an injection pipe arranged in an injection hole and opening at its downstream end into a leach zone at the bottom of the injection hole, allowing the lixiviant to leach the ore thereby producing pregnant lixiviant containing metal compounds of the ore, recovering the pregnant lixiviant from a production hole, separating the metal compounds from the lixiviant, regenerating and reoxygenating the lixiviant, and recycling the reoxygenated lixiviant down the injection pipe, the improvement comprising the steps of:

(a) selecting the inner diameter of the injection pipe taking into account the volumetric flow rate of the lixiviant, the hydrostatic increase in pressure and the drop in pressure due to loss of head during the transportation of the lixiviant from the upstream end to the downstream end of the injection pipe so that the pressure of the lixiviant slightly increases as it is transported down the injection pipe, and reducing the pressure of the lixiviant to a pressure only slightly greater than the pressure at the upstream end of the injection pipe by throttling the solution through constriction means arranged in downstream end of the injection pipe;

(b) maintaining the pressure of the lixiviant at the upstream end of the injection pipe less tha the fracturing pressure of the rock at the top of the leach zone; and (c) maintaining the concentration of the dissolved oxygen in the lixiviant at a value less than the saturation point for the pressure of the lixiviant at the upstream end of the injection pipe.

7. The method of claim 6, wherein the difference in the pressure between the upstream end and the downstream end of the injection pipe is less than or equal to 1 bar.

8. In a method for in-situ mining by leaching ore with a two-phase lixiviant comprising a leach solution or liquor admixed with oxygen, circulating the lixiviant down an injection pipe arranged in an injection hole and opening at its downstream end into a leach zone at the bottom of the injection hole, allowing the lixiviant to leach the ore thereby producing pregnant lixiviant containing metal compounds of the ore, recovering the pregnant lixiviant from a production hole, separating the metal compounds from the lixiviant, regenerating and reoxygenating the lixiviant, and recycling the reoxygenated lixiviant down the injection pipe, the improvement comprising the steps of:

(a) selecting the inner diameter of the injection pipe taking into account the volumetric flow rate of the lixiviant, the hydrostatic increase in pressure and the drop in pressure due to loss of head during the transportation of the lixiviant from the upstream end to the downstream end of the injection pipe so that the pressure of the lixiviant at the downstream end of the injection pipe is substantially equal to or greater than the pressure of the lixiviant at the upstream end of the injection pipe and the pressure of the lixiviant being transported down the injection pipe slightly increases as it is transported down the injection pipe slightly increases as it is transported down the injection pipe, and reducing the pressure of the lixiviant to a pressure substantially equal to that of the pressure at the upstream end of the injection pipe by throttling the solution through constriction means arranged in the lower part of the injection pipe; wherein the inner diameter d of the injection pipe is determined substantially in accordance with the formula: where $$d > [(32fQ^2)/(\pi^2 g)]^{1/5}$$

Q is the volumetric flow rate of the lixiviant, in $m^3/s$ $f = 0.0014 + 0.125\ Re^{-0.32}$ with $Re = 4\rho Q/(\pi d \mu)$ $g = 9.81\ m/s^2$ $\rho$ is the density of the solution, in $kg/m^3$, and $\mu$ is the dynamic viscosity of the solution, in pascal seconds;

(b) maintaining the pressure of the lixiviant at the upstream end of the injection pipe less than the fracturing pressure of the rock at the top of the leach zone; and (c) maintaining the concentration of the dissolved oxygen in the lixiviant at a value less than the saturation point for the pressure of the lixiviant at the upstream end of the injection pipe.

9. In a method for in-situ mining by leaching ore with a two-phase lixiviant comprising a leach solution or liquor admixed with oxygen, circulating the lixiviant down an injection pipe arranged in an injection hole and opening at its downstream end into a leach zone at the bottom of the injection hole, allowing the lixiviant to leach the ore thereby producing pregnant lixiviant containing metal compounds of the ore, recovering the pregnant lixiviant from a production hole, separating the metal compounds from the lixiviant, regenerating and reoxygenating the lixiviant, and recycling the reoxygenated lixiviant down the injection pipe, the improvement comprising the steps of:

(a) selecting the inner diameter of the injection pipe taking into account the volumetric flow rate of the lixiviant, the hydrostatic increase in pressure and the drop in pressure due to loss of head during the transportation of the lixiviant from the upstream end to the downstream end of the injection pipe so that the pressure of the lixiviant at the downstream end of the injection pipe is substantially equal to the pressure of the lixiviant at the upstream end of the injection pipe and the pressure of the lixiviant being transported down the injection pipe increases as it is transported down the injection pipe, and reducing the pressure of the lixiviant to a pressure only slightly greater than the pressure at the upstream end of the injection pipe by throttling the solution through constriction means arranged in the downstream end of the injection pipe, wherein the inner diameter d of the injection pipe is determined substantially in accordance with the formula:

where $$d > [(32fQ^2)/(\pi^2 g)]^{1/5}$$

Q is the volumetric flow rate of the lixiviant, in $m^2/s$ $f = 0.0014 + 0.125\ Re^{-0.32}$ with $Re = 4\rho Q/(\pi d \mu)$ $\rho$ is the density of the solution, in $kg/m^3$, and $\mu$ is the dynamic viscosity of the lixiviant, in pascal seconds;

(b) maintaining the pressure of the lixiviant at the upstream end of the injection pipe less than the fracturing pressure of the rock at the top of the leach zone; and (c) maintaining the concentration of the dissolved oxygen in the lixiviant at a value less than the saturation point for the pressure of the lixiviant at the upstream end of the injection pipe.

10. The method of claim 5, wherein the pressure drop across the constriction means is less than 5 bars.

11. The method of claim 6, wherein the pressure drop across the constriction means is less than 5 bars.

12. The method of claim 1, further comprising providing a network of injection holes associated with a network of production holes, and providing a recovery pipe in each of the production holes having at the lower end thereof at an intermediate level in the leach zone a volumetric pump having a constant flow rate corresponding to the nominal flow rate of production of the associated production hole.

13. Apparatus for in-situ mining by leaching ore, comprising an injection hole, an injection pipe arranged in said injection hole, a production hole spaced from said injection hole, means for recovering pregnant lixiviant containing metal compounds from said production hole, means for separating the metal compounds from the pregnant lixiviant, means for regenerating the lixiviant, a pressure pump for delivering regenerated lixiviant to an oxygenator, means for measuring the flow rate of the oxygenated lixiviant provided at an upstream end of said injection pipe, and the inner diameter of said injection pipe being such that the pressure of the lixiviant at a downstream end of said injection pipe is substantially equal to the pressure of the lixiviant at the upstream end of said injection pipe.

14. Apparatus of claim 13, wherein the inner diameter of said injection pipe is determined substantially in accordance with the formula:

$$[32fQ^2/(\pi^2 g)]^{1/5}$$

where

Q is the volumetric flow rate of the solution, in $m^3/s$ $f = 0.0014 + 0.125\ Re^{-0.32}$ with $Re = 4\rho Q/(\pi d \mu)$ $g = 9.81\ m/s^2$ $\rho$ is the density of the lixiviant, in $kg/m^3$, and $\mu$ is the dynamic viscosity of the lixiviant, in pascal seconds.

15. Apparatus of claim 13 or 14, wherein said oxygenator is followed by a phase separator, said separator comprising means for recycling the gas phase into said oxygenator.

16. Apparatus of claim 13 or 14, wherein said means for recovering pregnant lixiviant comprises a production hole and a recovery pipe arranged in said production hole, a constant flow rate volumetric pump being provided at the lower end of said recovery pipe.

17. Apparatus of claim 13 or 14, wherein said injection pipe comprises constriction means arranged in its lower part.

18. Apparatus of claim 13 or 14, wherein there is a network of injection holes associated with a network or production holes, each of said production holes being provided with a recovery pipe, each of said recovery pipes comprising at the lower end thereof, at an intermediate level in said leach zone, a volumetric pump having a constant flow rate corresponding to the nominal flow rate of production of said production hole.

19. The method of claim 5, 6, 8, or 9, wherein the pressure of the lixiviant at the upstream end of the injection pipe is maintained at a value slightly less than the fracturing pressure of the rock at the top of the leach zone, and the concentration of dissolved oxygen in the lixiviant is maintained at a value slightly less than the saturation point for the upstream pressure of the lixiviant.

* * * * *